US005221161A

United States Patent [19]

Toy

[11] Patent Number: 5,221,161

[45] Date of Patent: Jun. 22, 1993

[54] BALLAST TANK FOR BUOYANCY COMPENSATION

[76] Inventor: Jeffrey W. Toy, Jeffersonville Postal Service, Court Ave., Jeffersonville, Ind. 47130

[21] Appl. No.: 887,874

[22] Filed: May 26, 1992

[51] Int. Cl.[5] ..... B63C 11/30

[52] U.S. Cl. ..... 405/186; 405/185

[58] Field of Search ..... 405/185, 186, 187, 205, 405/209; 441/90, 91, 106, 108

[56] References Cited

U.S. PATENT DOCUMENTS 3,605,418 9/1971 Levine ..... 405/186

3,643,449 2/1972 Murphy ..... 405/186

4,472,082 9/1984 Kroling ..... 405/186

4,872,783 10/1989 Greenwood ..... 405/186

*Primary Examiner*—David H. Corbin

*Attorney, Agent, or Firm*—James C. Eaves, Jr.

[57] ABSTRACT

A ballast tank for buoyancy compensation for scuba diving which permits greater control through the use of a hydraulic induced vacuum. The apparatus includes a rigid tank 10 and pistons 12 and 20 which are controlled by manually operated hydraulic hand pump 32 and a pressure relief valve 26 so that desired displacement is achieved and maintained regardless of external water pressure.

6 Claims, 3 Drawing Sheets

BALLAST TANK FOR BUOYANCY COMPENSATION

BACKGROUND OF THE INVENTION

1. Field of the Invention

This invention relates to a ballast tank for buoyancy compensation, specifically to scuba diving buoyancy control.

2. Background of the Prior Art

In the prior art, buoyancy compensation devices have used compressed air to displace water, which changes buoyancy.

The most common design to date is a buoyancy compensation vest. U.S. Pat. No. 4,000,534 to Cerniway (1977) discloses an inflatable bladder device for scuba. The buoyancy compensator vest is based on the principal of displacement through compressed air, supplied by the divers breathable compressed air tank.

Due to the flexible design of the vest, changes of depth in the water become uncontrollable. For example, if a diver is trying to hold neutral buoyancy at a particular depth and inhales, he will ascend a short distance due to the expansion of air in the chest cavity. Due to the divers ascent in the water, the ambient water pressure decreases, therefore the air in his vest expands; this turns into a compounding effect that will send the diver into an uncontrollable ascent to the surface which can cause life threatening injuries. All of the buoyancy compensators heretofore known suffer from a number of disadvantages:

(1) Previous buoyancy compensators do not offer the diver buoyancy control because they operate on compressed air and air is compressible;

(2) The source of air for buoyancy comes from the breathable air supply, which greatly decreases the divers bottom time, and also the diver's sole source of life support;

(3) Descent is also a problem with the present day buoyancy compensators, the increase in water pressure compresses the air in the buoyancy compensator vest and causes the diver to descend uncontrollably, in which he can either descend to dangerous, life threatening depths, or hit the ocean floor and damage coral reefs; and, (4) Since the vest is filled with air it is also very cumbersome and binding.

SUMMARY OF THE INVENTION

Accordingly, besides the objects and advantages of the ballast tank, several objects and advantages of the present invention are:

(a) to provide buoyancy compensation that operates on hydraulics which are noncompressible;

(b) to provide the diver with buoyancy control that is capable of holding consistent displacement and is therefore able to resist over expansion or contraction and uncontrolled ascents or descents;

(c) to avoid using the breathable air supply to control ascent or descent;

(d) to provide the diver with less binding gear;

(e) to extend bottom time for the diver; and, (f) to protect the environment in accordance with the coral reef preservation movement.

Further objects and advantages are to provide a buoyancy compensator which can easily and conveniently be used by the diver while under water, and allow for neutral buoyancy. Still further objects and advantages will become apparent from a consideration of the ensuing description and drawings.

DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1A:
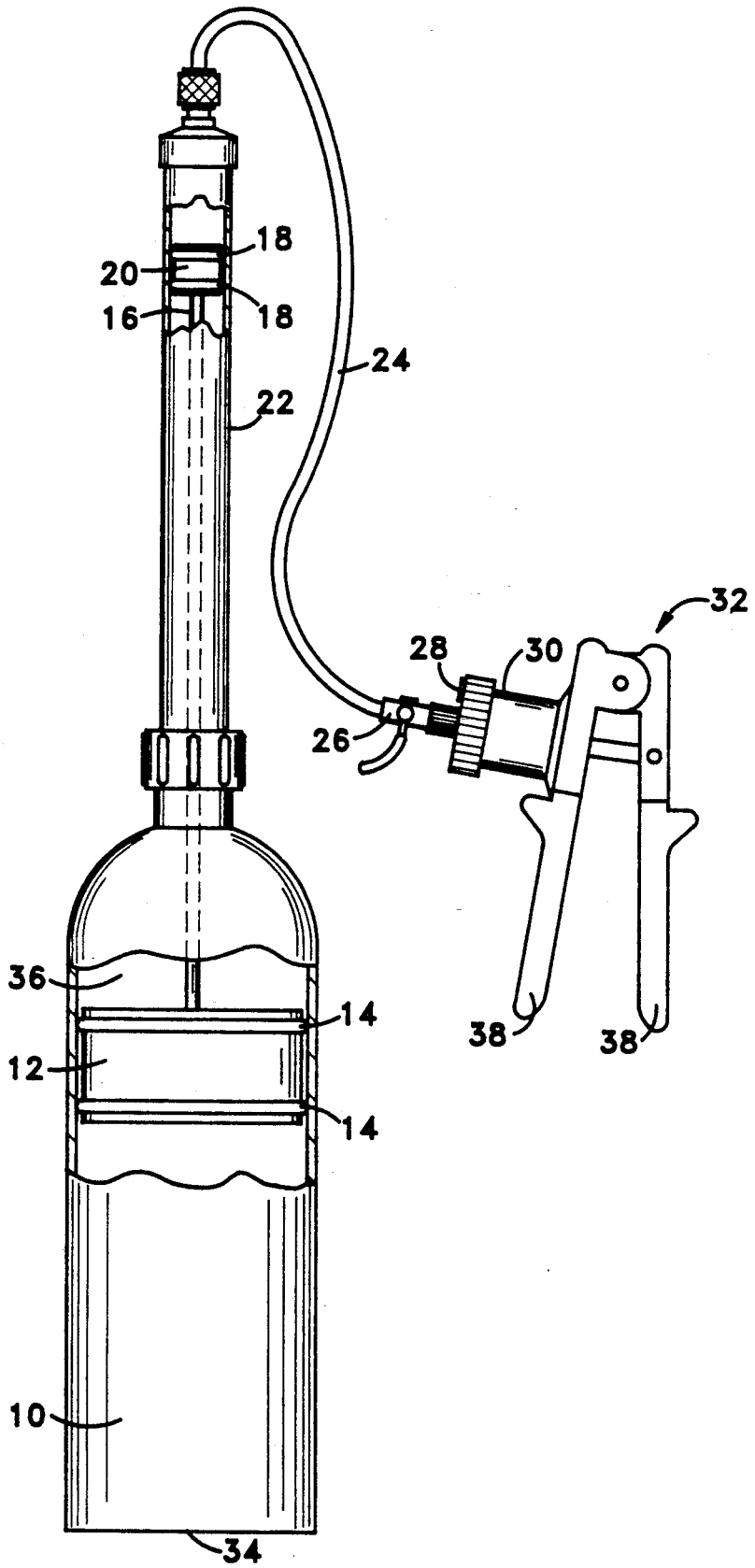
FIG. 1A shows a side view of the buoyancy compensator of the present invention.
Figure 1B:
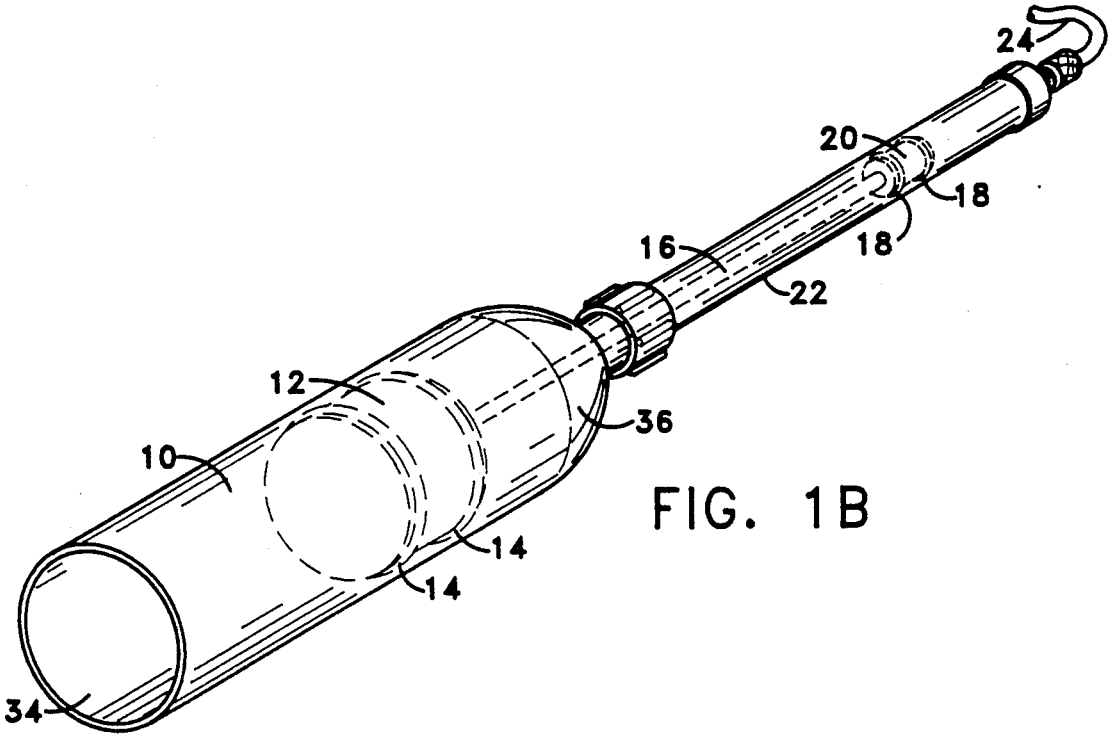
FIG. 1B shows a perspective view of the tank, actuator, and piston assembly of the buoyancy compensator of the present invention.

A typical embodiment of the buoyancy compensator of the present invention is illustrated in FIG. 1A (side view). The buoyancy compensator has a round ballast tank 10; a movable piston 12, which is sealed by rubber piston rings 14; and, a connecting piston rod 16 which connects to the smaller piston 20 of the hydraulic actuator 22. Small piston rings 18 seal small piston 20. The hydraulic actuator 22 is connected by high pressure hose 24 to hand pump assembly 32. The piston driven pump 30 is fed ambient water through intake valve 28 and pressure is relieved by pressure relief valve 26. The tank's overall dimensions are 10.5 centimeters diameter, 31 centimeters length. The hydraulic actuator is 1.7 centimeters diameter, 31 centimeters length.

Figure 3:
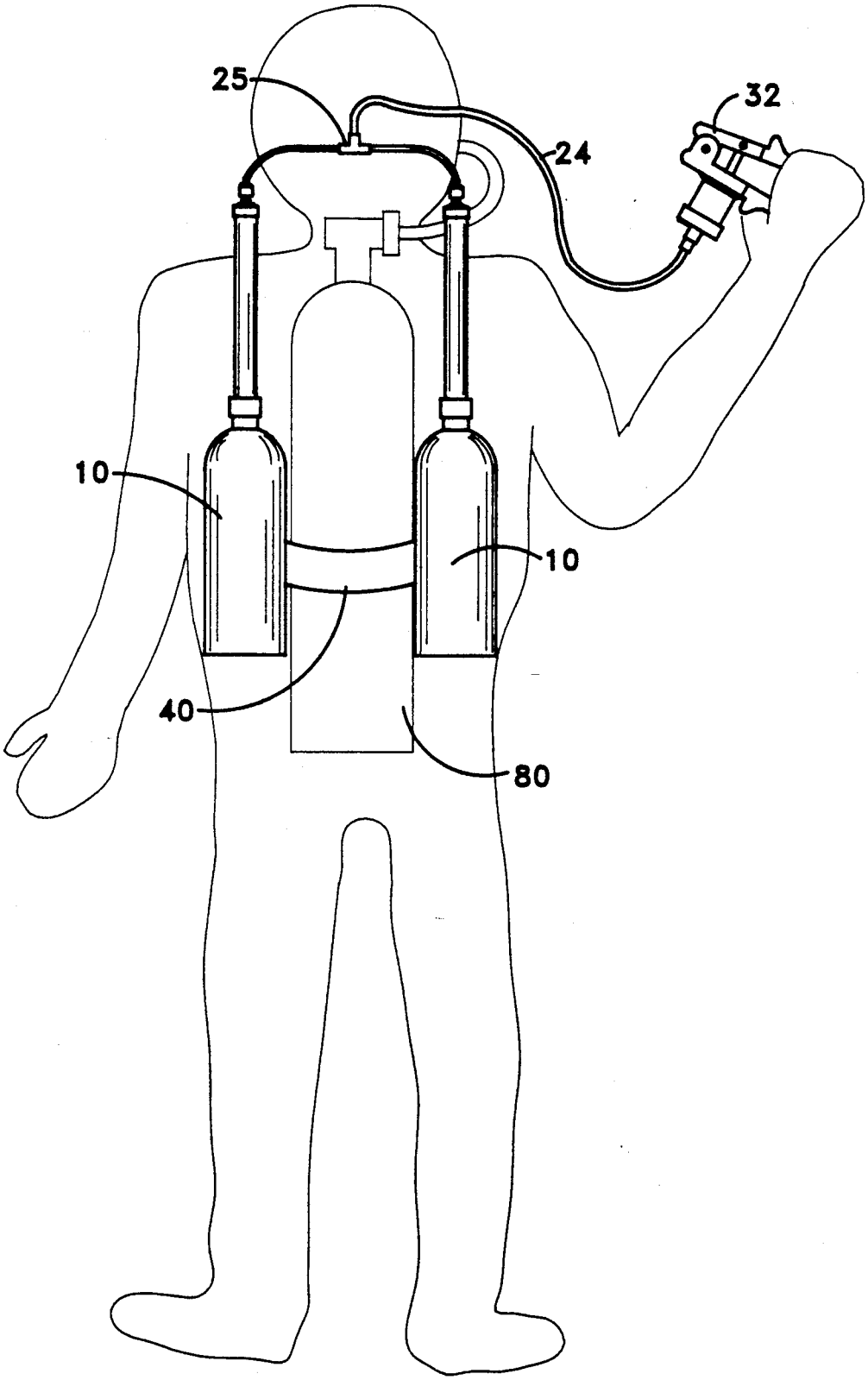

There are various possibilities with regard to the relative shape and size of the ballast tank. The larger the tank, the more displacement or lift it provides. Using ballast tanks mounting strap 40, two tanks 10 of the size I have chosen can be strapped to the diver's back-pack scuba tank 80, as shown in FIG. 3, without being cumbersome and still give maximum buoyancy control. As is seen in FIG. 3, a single hand pump assembly 32 is connected to both tanks 10 by hydraulic hose 24. Hose 24 branches or has a T-connector 25 therein to permit the connection to both tanks 10.

From the description above, a number of advantages of my ballast tank become evident:

(a) With the use of rigid materials its displacement will not change when there is a change in ambient water pressure;

(b) The use of hydraulics to select the amount of displacement;

(c) The use of ambient water or sea water in the pump where the diver is diving eliminates the risk of pollution from hydraulic oils; and, (d) Air is trapped between the pistons which forms the vacuum.

Figure 2A:
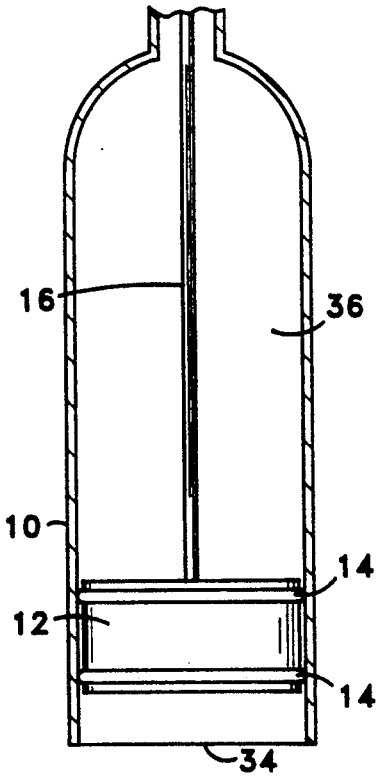
FIGS. 2A and 2B show location of the piston assembly within the tank of the present invention to create positive and negative buoyancy, respectively; and, FIG. 3 shows a back view of a diver using a dual tank buoyancy compensator of the present invention.
Figure 2B:
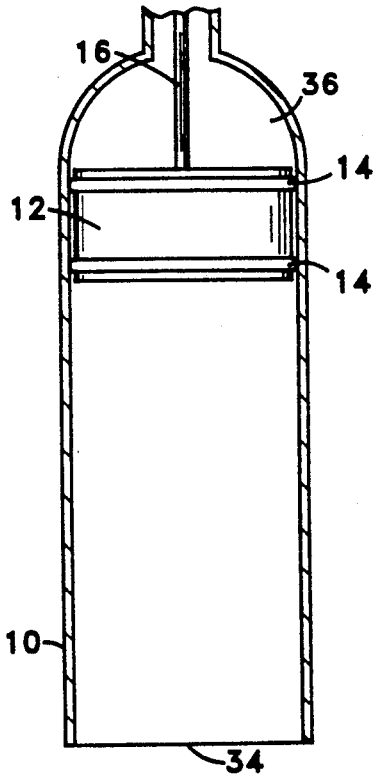

The manner of using by ballast tank for buoyancy compensation as shown in the drawings of my patent is different from previous art; namely, the hydraulic and vacuum principles. One must first don the tank and enter the water, similar to the application in FIG. 3, because the ambient water or sea water is used as a source of my systems hydraulics. The piston 12 is in the starting position at the top of the tank, as shown in FIG. 2B. This creates negative buoyancy, as it allows water to fill the tank 10 through the water inlet 34 and makes the diver descend. As the diver descends, he will pump water into the system with the hand pump levers 38. Water will be drawn into the pump 30 at the intake valve 28 and pass through the pump 30 into the hydraulic hose 24. As the hydraulic pressure increases, it will push the small piston 20 down the hydraulic actuator 22. This pushes the connecting piston rod 16 and the large piston 12 down the ballast tank 10. Thereby, pushing water out inlet 34.

There is a small amount of air trapped between the two pistons 12 and 20 during assembly of the system. As the volume of the space 36 increases with the downward travel of the pistons, it creates a vacuum. The diver will stop at a depth where his displacement equals his weight (neutral buoyancy). If he wants to ascend, he will pump more water into the system which increases displacement, creating positive buoyancy as seen in FIG. 2A. Or if he wants to descend, he will press the lever on the pressure relief valve 26. The vacuum pulls the piston 12 back to its starting point when hydraulic pressure is allowed to escape from the pressure relief valve. This causes descent.

Accordingly, the diver will see that the ballast tank system can be used more safely and efficiently. Furthermore, the ballast tank has the additional advantages in that:

(a) it permits consistent displacement with the use of hydraulics;

(b) it provides hydraulic properties without hydraulic oil, which can harm our oceans and lakes;

(c) it can be manufactured out of common building materials; and, (d) it conserves divers breathable air supply.

Although the description above contains many specifications, these should to be construed as limiting the scope of the invention, but as merely providing illustrations of some of the presently preferred embodiments of this invention. For example, the tank can have other shapes such as oval, etc.; and various sizes for different amounts of displacement. This system could be used for buoyancy control of other submarine devices, mini subs, submarines, under-water robots, etc.

Thus the scope of the invention should be determined by the appended claims and their legal equivalents, rather than by the examples given.

I claim:

1. A hydraulic induced vacuum buoyancy compensator, comprising:

(a) a larger diameter cylinder and a smaller diameter cylinder connected to said larger cylinder, said larger cylinder containing a sealed larger movable piston therewithin and said smaller cylinder containing a sealed smaller movable piston therewithin, said larger and smaller pistons connected by a piston rod, said larger cylinder having a water opening therein, whereby when said buoyancy compensator is in use by a diver underwater, water is contained in a first space between said water opening and said larger piston (b) a pump in flow communication with said smaller cylinder, said pump activatable to pump water into said smaller cylinder and thereby exert pressure to move said smaller movable piston and hence said larger movable piston in a first direction toward said water opening in said larger cylinder to create a vacuum in a second space within said larger and smaller cylinders between said sealed larger and smaller pistons; and, (c) a valve to relieve said pressure and thereby allow said smaller piston to move in a second direction opposite said first direction away from said water opening in said larger cylinder.

2. The hydraulic induced vacuum buoyancy compensator of claim 1, further comprising: at least one mounting strap which permits a diver to strap said hydraulic induced vacuum buoyancy compensator to a scuba tank.

3. A buoyancy compensator for use underwater, comprising:

(a) a cylindrical-shaped hollow ballast tank having a water inlet end and a hydraulic actuator end, said ballast tank having a preselected diameter, said water inlet end having an opening therethrough;

(b) a cylindrical-shaped hollow hydraulic actuator having a hose end and a ballast tank end, said hydraulic actuator having a preselected diameter, said diameter of said hydraulic actuator being less than said diameter of said ballast tank, said hydraulic actuator end of said ballast tank and said ballast tank end of said hydraulic actuator being connected;

(c) a movable large piston and at least one large piston ring, said large piston sealably contained within said ballast tank by said at least one large piston ring and movable within said ballast tank;

(d) a movable small piston and at least one small piston ring, said small piston sealably contained within said hydraulic actuator by said at least one small piston ring and movable within said hydraulic actuator;

(e) a connecting piston rod of preselected length having a ballast tank end connected to said large piston and a hydraulic actuator end connected to said smaller piston;

(f) a hose having a hydraulic actuator end and a pump end, said hydraulic actuator end being connected to said hose end of said hydraulic actuator; and, (g) a hand pump assembly in flow communications with said pump end of said hose, said hand pump assembly including a hand pump lever assembly, a water intake valve, and a pressure relief valve, wherein said hand pump lever assembly is operable to cause said water intake valve to receive water which said pump assembly pumps into said pump end of said hose thereby pumping water through said hose and into said hose end of said hydraulic actuator thereby exerting pressure on said smaller piston and causing said smaller piston to move in a first direction toward said water inlet end of said larger cylinder thereby creating a vacuum in a space within said larger and smaller cylinders between said larger and smaller pistons, and whereby said pressure relief valve is operable to permit water to exit said hose end of said hydraulic actuator thereby relieving pressure on said smaller piston and causing said smaller piston to move in a second direction opposite said first direction.

4. The buoyancy compensator for use underwater of claim 3, further comprising: at least one mounting strap which permits a diver to strap said buoyancy compensator to a scuba tank.

5. A buoyancy compensator for use underwater, comprising:

(a) at least two cylindrical-shaped hollow ballast tanks, each said tank having a water inlet end and a hydraulic actuator end, each said ballast tank having a preselected diameter, said water inlet end having an opening therethrough;

(b) at least two cylindrical-shaped hollow hydraulic actuators, one of said actuators being connected to one of said ballast tanks, each said actuator having a hose end and a ballast tank end, each said hydraulic actuator having a preselected diameter, said diameter of each said hydraulic actuators being less than said diameter of said ballast tank to which said actuator is connected, said hydraulic actuator end of one of said ballast tanks and said ballast tank end of one of said hydraulic actuators being connected;

(c) at least two movable large pistons, each large piston having at least one large piston ring, each said large piston sealably contained within said one of said ballast tanks by said at least one large piston ring and movable within said one of said ballast tanks;

(d) at least two movable small pistons, each small piston having at least one small piston ring, each said small piston sealably contained within said one of said hydraulic actuators by said at least one small piston ring and movable within said one of said hydraulic actuators;

(e) at least two connecting piston rods, each of said rods having a preselected length and having a ballast tank end connected to said one of said large pistons and a hydraulic actuator end connected to said one of said smaller pistons;

(f) a hose having at least two hydraulic actuator ends and a pump end, each of said hydraulic actuator ends being connected to one of said hose ends of said one of said hydraulic actuators; and, (g) a hand pump assembly in flow communications with said pump end of said hose, said hand pump assembly including a hand pump lever assembly, a water intake valve, and a pressure relief valve, wherein said hand pump lever assembly is operable to cause said water intake valve to receive water which said pump assembly pumps into said pump end of said hose thereby pumping water through said hose and into said hose ends of said hydraulic actuators thereby exerting pressure on said smaller pistons and causing said smaller pistons to move in a first direction toward said water inlet ends of said large cylinders thereby creating a vacuum in a space within each of said larger and smaller cylinders between each of said larger and smaller pistons, and whereby said pressure relief valve is operable to permit water to exit said hose ends of said hydraulic actuators thereby relieving pressure on said smaller pistons and causing said smaller pistons to move in a second direction opposite said first direction.

6. The buoyancy compensator for use underwater of claim 5, further comprising: at least one mounting strap which permits a diver to strap said buoyancy compensator to a scuba tank.

* * * * *

UNITED STATES PATENT AND TRADEMARK OFFICE

CERTIFICATE OF CORRECTION

PATENT NO. : 5,221,161

DATED : June 22, 1993

INVENTOR(S) : Jeffrey W. Toy

It is certified that error appears in the above-identified patent and that said Letters Patent is hereby corrected as shown below:

Column 3, line 35, delete [to] and insert therefor --not--.

Signed and Sealed this

Eighth Day of March, 1994

Bruce Lehman

*Attest:*

BRUCE LEHMAN

*Attesting Officer*

*Commissioner of Patents and Trademarks*